US005506664A

United States Patent [19]

Maher et al.

[11] Patent Number: 5,506,664

[45] Date of Patent: Apr. 9, 1996

[54] SENSOR FOR MEASURING TONER APPLYING CAPABILITY

[75] Inventors: James C. Maher, North Rose; Douglas C. Anderson, Pittsford; Richard A. Weitzel, Hilton, all of N.Y.

[73] Assignee: Eastman Kodak Company, Rochester, N.Y.

[21] Appl. No.: 233,556

[22] Filed: May 5, 1994

[51] Int. Cl.[6] ..... G03G 21/00

[52] U.S. Cl. ..... 355/246; 118/688; 355/208

[58] Field of Search ..... 355/245, 246, 355/208; 118/688–694

[56] References Cited

U.S. PATENT DOCUMENTS 4,431,300 2/1984 Snelling ..... 355/246

4,648,702 3/1987 Goto ..... 355/208

4,866,481 9/1989 Yamada et al. ..... 355/246

5,270,784 12/1993 Nakane et al. ..... 118/691 X

*Primary Examiner*—A. T. Grimley

*Assistant Examiner*—Shuk Y. Lee

*Attorney, Agent, or Firm*—Leonard W. Treash, Jr.

[57] ABSTRACT

A sensor measures the toner applying capability of a toning station. It includes a transparent conductive rotatable member which is rotated through a developer applying zone and a sensing position remote from the developer applying zone. Toner is applied by developer in the station to the exterior surface of the rotatable member as controlled by a bias applied to the rotatable member. The applied toner is sensed by a transmission densitometer at the sensing position. The output can be used to control toner concentration, an original charge on an image member or a development bias applied to the toner station.

7 Claims, 2 Drawing Sheets

SENSOR FOR MEASURING TONER APPLYING CAPABILITY

This invention relates to the toning of electrostatic images and, more particularly, to a sensor for measuring the capability of a toning station to apply toner.

U.S. Pat. Nos. 4,431,300 to Snelling, issued Feb. 14, 1984, and 4,648,702 to Goto, issued Mar. 10, 1987 , each show a device for measuring the capability of the toning station to apply toner. A flat, transparent, conductive plate is positioned in contact with developer on a magnetic brush applicator. The conductive plate is biased to be attractive to toner in the developer. The bias is chosen to be comparable to a portion of an electrostatic image to be toned by the toning station. An optical sensor positioned above the plate senses light reflected off the toner applied to the plate. This provides an output indicative of the ability of the toning station to apply toner to an electrostatic image having potential comparable to that of the plate.

In both of the above devices, the output of the sensor is primarily used to control toner concentration. However, the Snelling patent also suggests that it be used for regulating primary charging and an electrical bias applied to the development station.

Modem copiers and printers obtain somewhat similar information by toning one or more control patches on an image member and optically sensing the density of each patch. These control patches provide useful information for adjustment of the image forming apparatus but create their own set of problems, not the least of which is their placement on the image member and their cleaning after use.

The sensors shown in the two references solve some of these problems associated with control patches but have their own problems associated with reflectivity sensing. That is, light incident on the toner applied to the flat plate is also commonly incident on developer in the toner applying zone which may not be readily distinguishable from the toner itself.

SUMMARY OF THE INVENTION

It is an object of the invention to provide a sensor for measuring the toner applying capability of a toning station, which toning station includes means for moving a toner containing developer through toning relation with an electrostatic image, which sensor is improved in sensing ability over prior flat plate devices.

These and other objects are accomplished by a sensor with a rotatable member having an exterior surface. Means for rotating the rotatable member causes the exterior surface to rotate through a toner applying zone in toner applying relation with the moving developer and through a sensing position remote from the toner applying zone. A means for creating an electric field creates an electric field in the toner applying zone of a direction urging toner to the exterior surface. The amount of toner deposited on the exterior surface is sensed at the sensing position by a sensing means.

According to a preferred embodiment, the rotatable member is transparent and conductive and the sensing means includes a light source and a light sensing device positioned on opposite sides of the exterior surface. Light is then projected through the toner on the surface to the sensor. A sensor constructed according to the preferred embodiment uses transmission density sensing at a position remote from the main body of developer. Thus, it uses a more sensitive approach to determining the density of the developer at a position away from the high source of noise provided by the body of the developer in prior devices.

According to a further preferred embodiment, the electrical field in the toner applying zone is variable by applying a variable bias to the rotatable member. This allows the sensor to provide information indicative of the toning capability of the toning station for all portions of a continuously variable electrostatic image. It thus permits the apparatus to construct an entire developability curve for the toning station.

DESCRIPTION OF THE PREFERRED EMBODIMENTS

Figure 1:
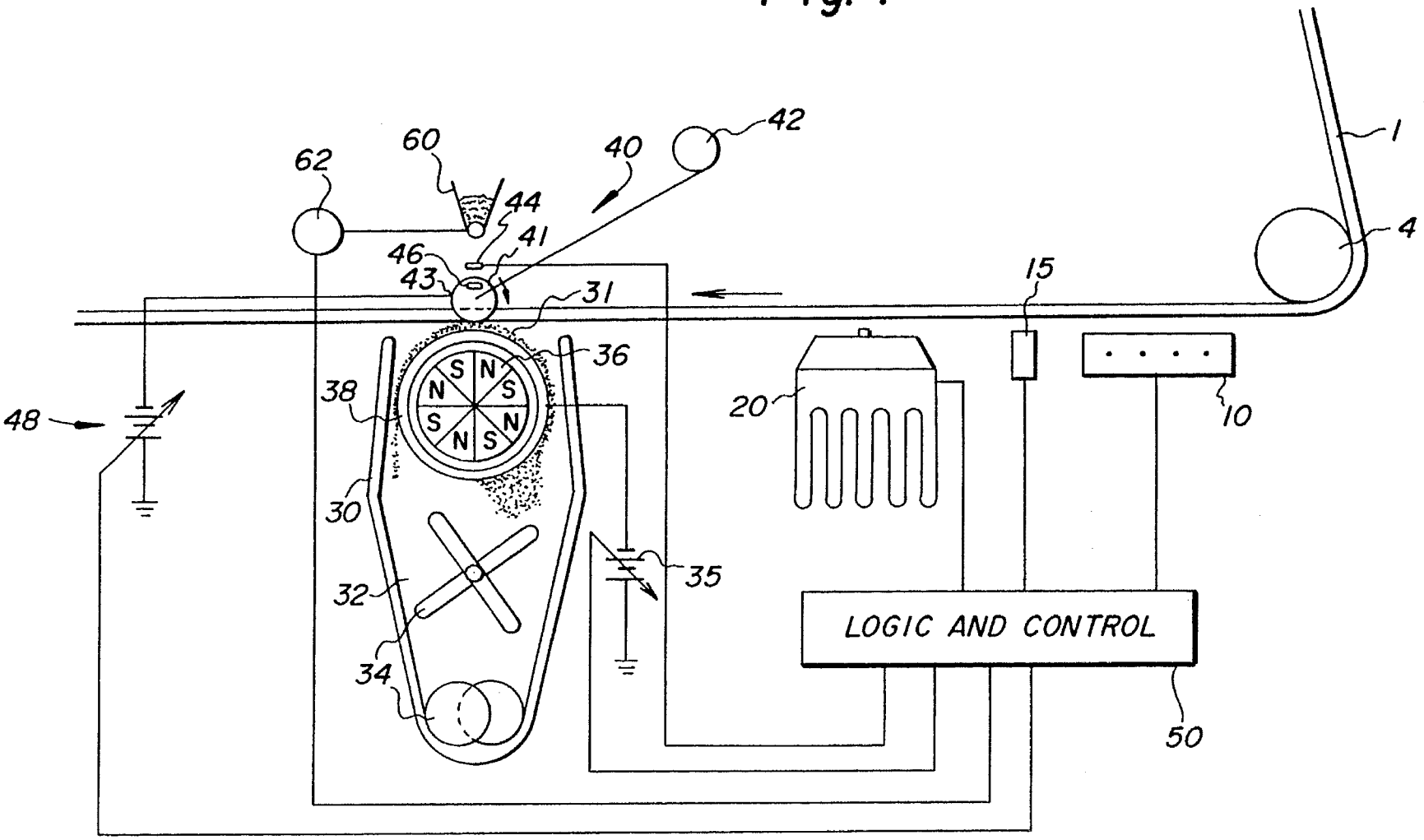
FIG. 1 is a front schematic of a portion of an image forming apparatus with parts in section.

FIG. 1 shows a portion of an image forming apparatus in which the invention is useful. Image member 1, for example, a photoconductive belt, is trained about a series of rollers, including roller 4, for movement past a series of stations to create toner images as controlled by logic and control 50. Image member 1 first passes a charging station 10 which applies a uniform charge to it. The amount of charge on image member 1 is controlled by logic and control 50 which can be assisted by a potentiometer 15 which measures the charge applied.

The charged image member 1 is imagewise exposed by an exposing means, for example, an LED printer 20 also controlled by logic and control 50, to create an electrostatic image. The electrostatic image is toned by a toning station 30 to create a toner image which is later used, for example, by being transferred to a receiving sheet.

Toning station 30 includes a sump 32 for holding a developer 31, which developer 31 includes fine particulate, dry toner to be applied to the electrostatic image. The developer 31 can be either a one or a two component developer. However, it is preferably a two component developer including, in addition to the toner, magnetic carrier particles. In sump 32 is a conventional mixing mechanism 34 including a paddle and a pair of augers. The mixing mechanism makes developer 31 available to a sleeve or shell 38 which surrounds a magnetic core 36. Either the magnetic core 36 or the sleeve 38, or both, are rotatable to move developer on the sleeve through toning relation with the electrostatic image on image member 1. Bias is applied to the sleeve by a variable DC potential source 35 to provide an electrical field between the sleeve 38 and the image member 1 to control toning of the image. Typically, the bias is chosen to encourage toning of image areas and discourage toning of background areas in the electrostatic image.

Toning of electrostatic images uses toner from the developer 31. As toner is used up, the concentration in the developer decreases and toner must be added to the sump from a toner supply 60. A motor 62 controls a valve on toner supply 60 and is actuated by logic and control 50 in response to a signal that toner should be added to sump 32.

Figure 2:
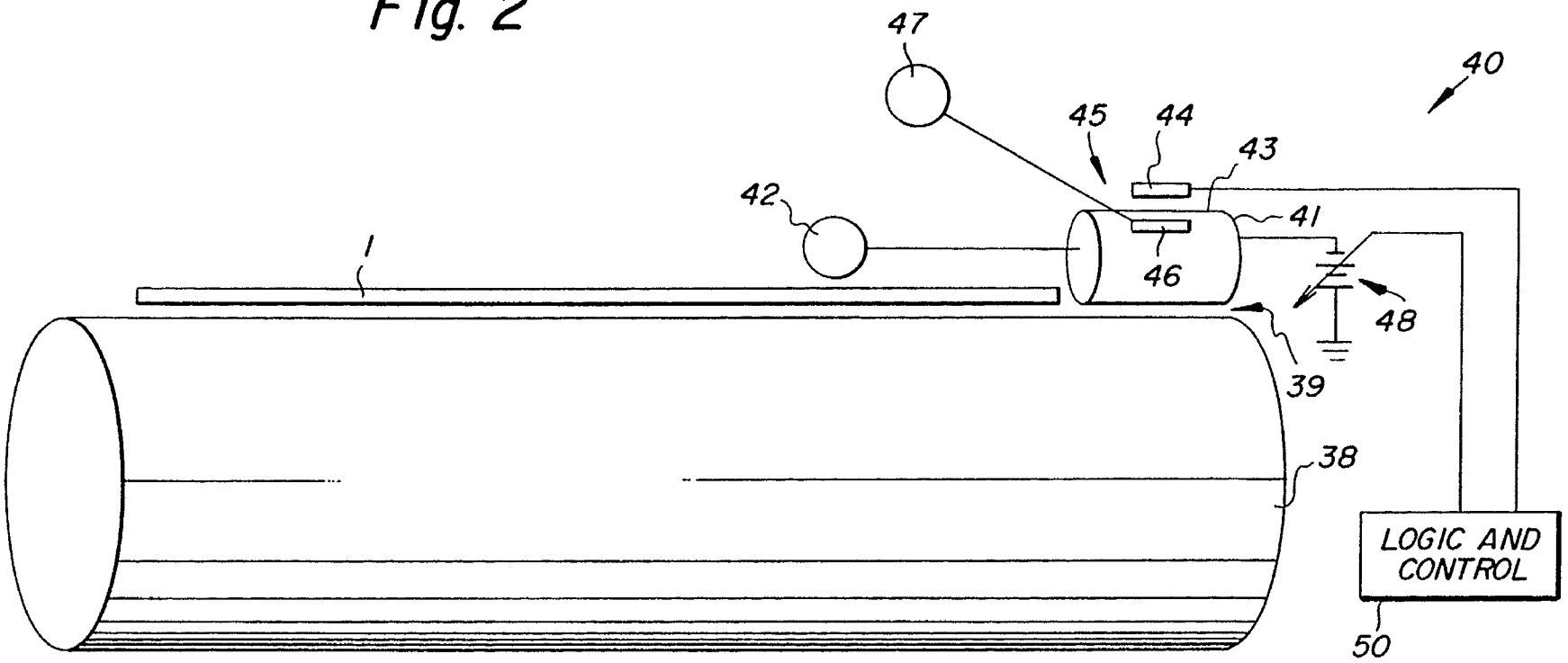
FIG. 2 is a left perspective view of part of a toning station shown in the FIG. 1 apparatus.

According to FIG. 2, the effectiveness of the toning station 30 is monitored by a sensor 40 which provides an input to logic and control 50 for use in control of the image forming apparatus. Sensor 40 includes a rotatable member, for example, a transparent conductive cylinder 41 having an exterior surface 43. A motor 42 rotates rotatable member 41, bringing exterior surface 43 through both a toner applying zone 39 opposite sleeve 38 and a sensing zone 45 remote from the toner applying zone. A variable source of DC potential 48 is used to apply a bias to rotatable member 41. The bias is comparable to a potential associated with some portion of an electrostatic image to be toned by the toning station 30. The bias applied by source 48 creates an electrical field that, at least to some extent, urges toner to be applied to the exterior surface 43. As the rotatable member 41 is rotated by motor 42, the toned exterior surface leaves the toner applying zone 39 and moves through the sensing position 45. At the sensing position a source of illumination 46, controlled by a power source 47 and located inside rotatable member 41, directs light (or other radiation) through rotatable member 41. This light passing through toner applied to the exterior surface 43 is sensed by an appropriate optical sensor 44 and converted to an electrical signal which is input to logic and control 50. Source 46 and sensor 44 essentially make up a conventional transmission densitometer commonly used for sensitometry in silver halide photography. Such a densitometer is also used in sensing toned patches on transparent image members.

The signal sent to the logic and control 50 can be used as in prior art devices to control the supply of toner from toner supply 60, to control the level of bias applied to the development station from potential source 35 and to control the level of potential originally applied to the image member by charging means 10.

Voltage source 48 is variable. This allows the toner applying capability of the toning station 30 to be measured at a variety of potentials comparable to the full range of potentials found in a gray level electrostatic image. This allows the apparatus to essentially plot the entire development curve for that toning station at that time. This curve will be most affected by the concentration of toner in the station 30. However, it will also be affected by the humidity and the original charge on the photoconductor. Any source of variation in toning capability can be accounted for.

According to a preferred embodiment of the invention, the rotatable member 41 includes alternating bands of conductive and non-conductive material on exterior surface 43. This allows the station to apply toner to the exterior surface, much as it would apply toner to a typical textural line image. At any particular voltage, a reading from optical sensor 44 will provide an indication of the thickness of the line formed, which is also an important quality of the image.

A primary advantage of the sensors shown in FIG. 2 over flat plate sensors using reflective optics, is that the sensing is done at a position remote from the toner applying zone. Sensing, thus, is not affected by the presence adjacent the toner being sensed of a large body of similarly colored developer. Further, it allows the use of transmission densitometry rather than reflective densitometry and thus provides a more accurate and reliable signal.

The invention has been described in detail with particular reference to a preferred embodiment thereof, but it will be understood that variations and modifications can be effected within the spirit and scope of the invention as described hereinabove and as defined in the appended claims.

We claim:

1. A sensor for measuring a toner applying capability of a toning station, which toning station includes means for moving a toner containing developer through toning relation with an electrostatic image, said sensor comprising:

a transparent conductive rotatable member having an exterior surface, means for rotating the rotatable member through a toner applying zone in toner applying relation with the moving developer and through a sensing position remote from the toner applying zone, means for creating an electrical field in the toner applying zone of a direction urging toner to the exterior surface, and means at said sensing position for sensing an amount of toner deposited on said exterior surface, said sensing means including a source of radiation and a radiation sensor located at said sensing position on opposite sides of said exterior surface.

2. The sensor according to claim 1 wherein said means for creating an electrical field is variable to create an electrical field providing the application of a variable amount of toner to said exterior surface.

3. Image forming apparatus including a toning station and a sensor for measuring the toner applying capability of the toning station constructed according to claim 1.

4. Image forming apparatus according to claim 3 further including a supply of toner and means for adding toner from said supply to said toning station in response to said sensing means.

5. Image forming apparatus according to claim 3 further including an image member, means for applying a uniform charge to the image member, means for imagewise exposing the image member to create an electrostatic image on the image member, a toning station for applying toner to the electrostatic image, and means for controlling the charge applied to the image member according to the amount of toner deposited on said exterior surface as sensed by said sensing means.

6. Image forming apparatus according to claim 5 including means for applying an electrical field between the toning station and an electrostatic image on said image member and means for adjusting said field between the electrostatic image and the toning station in response to the amount of toner deposited on said exterior surface as sensed by said sensing means.

7. Image forming apparatus comprising:

an image member movable along a path, means for forming an electrostatic image on the image member, a toning station positioned to apply toner to the electrostatic image on said image member, said toning station including elongated means for moving developer, including toner, through developing relation with the electrostatic image, said elongated means extending across the path of said image member and having a portion which extends beyond the path of the image member, a sensor for measuring a toner applying capability of the toning station, which sensor includes a rotatable member having an exterior surface positioned opposite the portion of the elongated means which extends beyond the path of said image member, means for rotating the rotatable member through a toner applying zone in toner applying relation with the developer and through a sensing position remote from the toner applying zone, means for creating an electrical field in the toner applying zone of a direction urging toner to the exterior surface of the rotatable member, and means at said sensing position for sensing an amount of toner deposited on said exterior surface.

* * * * *